US007273399B2

(12) United States Patent
LeGrow et al.

(10) Patent No.: US 7,273,399 B2
(45) Date of Patent: Sep. 25, 2007

(54) TRANSCEIVER ADAPTER

(75) Inventors: Robert C. LeGrow, North Andover, MA (US); Robert A. Sarbieski, Atkinson, NH (US); Bradley D. Shaw, Plaistow, NH (US)

(73) Assignee: Lucent Technologies Inc., Murray Hill, NJ (US)

( * ) Notice: Subject to any disclaimer, the term of this patent is extended or adjusted under 35 U.S.C. 154(b) by 153 days.

(21) Appl. No.: 11/156,738

(22) Filed: Jun. 20, 2005

(65) Prior Publication Data

US 2006/0286867 A1 Dec. 21, 2006

(51) Int. Cl.
*H01R 13/66* (2006.01)

(52) U.S. Cl. ..... 439/620.2

(58) Field of Classification Search ..... 439/620, 439/326, 328
See application file for complete search history.

(56) References Cited

U.S. PATENT DOCUMENTS

| | | | | |
|---|---|---|---|---|
| 6,848,927 | B2 * | 2/2005 | Shirai | 439/326 |
| 6,945,712 | B1 * | 9/2005 | Conn | 385/94 |
| 2003/0180012 | A1 * | 9/2003 | Deane et al. | 385/92 |
| 2005/0186810 | A1 * | 8/2005 | Sardella et al. | 439/76.1 |

* cited by examiner

*Primary Examiner*—J. F. Duverne

(57) ABSTRACT

An adapter for interconnecting a Small Form Factor Pluggable (SFP) transceiver into a receptacle configured to receive a Small Form Factor (SFF) transceiver. The innovative adapter provides an interface for connecting an SFP transceiver to an SFF receptacle (e.g. footprint) on a printed circuit board. This enables manufacturers and customers with printed circuit boards originally designed to receive and interoperate only with SFF transceivers, to replace SFF transceivers with newer SFP transceiver models through the use of the innovative interface described herein.

18 Claims, 6 Drawing Sheets

TRANSCEIVER ADAPTER

TECHNICAL FIELD

The present invention relates generally to optical transceivers, and more particularly, to connecting optical transceivers to printed circuit boards.

BACKGROUND

Optical transceivers are electro-optic devices that generally convert optical signals from a fiber optic cable into electrical signals, and vice versa. Optical transceivers are typically used as an interface between a fiber optic cable and a communication device, such as a communications node in a network and as such is usually mounted (i.e., attached) to a printed circuit board of a communication device as well as a fiber optic cable.

The way in which transceivers are attached to a printed circuit board is usually controlled by an industry standard. Industry standards ensure that each manufacturer of a transceiver meets certain criteria to ensure consistency for designs of printed circuit boards configured to receive the transceiver and interchangeability of transceivers among different manufacturers of transceivers. For instance, industry standards typically govern the size of a transceiver, packaging (if any) for retaining the transceiver, and its input and output (I/O) pin configurations including: the number of pins, spatial relation of each pin, electrical signal assignments for each pin, and so forth. Each industry standard inherently controls how to interface (i.e., to connect) the transceiver to a printed circuit board. For example, holes of a receptacle located on the printed circuit board for receiving pins of a transceiver or transceiver housing, must be complementary and align with the pins of the transceiver or transceiver housing. Additionally, the receptacle holes must align electrically with the signal assignments of the pins of a transceiver or transceiver housing.

Most transceivers are either manufactured in accordance with one of two industry standards: the Small Form Factor (SFF) or Small Form Factor Pluggable (SFP). Transceivers manufactured in accordance with the SFF industry standard ("SFF transceivers") are typically electrically and mechanically mounted directly to a printed circuit board. That is, the leads or pins of the SFF transceiver are soldered directly to a printed circuit board. The pins of the SFF transceiver are soldered to holes of a complimentary receptacle on the printed circuit. The holes of the printed circuit board are typically connected to conductive traces contained within the printed circuit board.

Increasingly, transceivers are being manufactured in accordance with the SFP standard ("SFP transceivers"). SFP transceivers have an advantage over SFF transceivers, as the SFP transceiver slides inside a housing and plugs into a connector located in the housing without the need for soldering or pin alignment. Accordingly, the SFP transceiver can be field replaced simply by pulling the SFP transceiver out of the housing and plugging in a replacement SFP transceiver. The housing and connector are mated to the printed circuit board, by mechanical and electrical mechanisms. Accordingly, when updates or improvements are made to a transceiver design, it can be installed onto the printed circuit board simply by pulling an older version of the SFP transceiver out of the SFP housing and inserting the updated version therein.

Unfortunately, customers that have printed circuit boards designed to connect with SFF transceivers cannot take advantage of the newer SFP transceivers, because the SFF and SFP transceiver footprints are not compatible with one another. That is, the housing and connector of an SFP transceiver has pins and fastening mechanisms that are not aligned with the holes of a receptacle configured to accept an SFF transceiver. Accordingly, replacing the SFF transceiver with an SFP transceiver is not possible, because even if the SFF transceiver is removed from the board, the SFP transceiver housing's footprint, and electrical pin assignment is incompatible with a receptacle on a printed circuit board configured to receive a SFF transceiver.

One possible solution to this problem involves redesigning the artwork of the printed circuit board and replacing the old SFF compliant printed circuit boards in their entirety. However, to design such a printed circuit board and replace the older ones is time consuming, expensive and inconvenient. This is especially problematic if there are multiple product lines each having different printed circuit board designs and sizes, as each must be customarily redesigned to include an SFP transceiver.

SUMMARY

To address the above-discussed deficiencies of the prior art, the present invention provides an adapter for interconnecting a Small Form Factor Pluggable (SFP) transceiver to a circuit pack of a communications device having a footprint intended to receive a Small Form Factor (SFF) transceiver.

In one exemplary implementation, the adapter includes a footprint that is formatted to accept complementary connector elements of an SFP transceiver housing/SFP connector, and is configured to electrically and mechanically connect with the SFP transceiver housing/SFP connector. The adapter may also include an SFF connector having leads that are complementary to a footprint formatted for SFF transceivers. The leads of the SFF connector are configured to electrically and mechanically connect with the SFF footprint on the printed circuit board. An electrical module of the adapter provides an electrical communication path between an SFP transceiver and the SFF footprint on the printed circuit board when an SFP transceiver is disposed in the SFP transceiver housing and connected to the SFP connector, and the SFF leads are connected to the receptacle of the printed circuit board.

As a result of using the innovative adapter described herein, manufacturers and customers can utilize printed circuit boards (such as motherboards of a communications device) originally designed to receive and interoperate only with SFF transceivers, to function now with newer SFP transceiver models. The adapter further eliminates the conventional problems of having to redesign printed circuit boards designed to function with SFF transceivers, which is a time consuming and costly process.

BRIEF DESCRIPTION OF THE DRAWINGS

The detailed description is described with reference to the accompanying figures. In the figures, the left-most digit(s) of a reference number identifies the figure in which the reference number first appears. It is emphasized that various features are not drawn to scale. In fact, the dimensions of the various features may be arbitrarily increased or reduced for clarity of discussion. Reference is now made to the following descriptions taken in conjunction with the accompanying drawings, in which.

DETAILED DESCRIPTION

Figure 1:
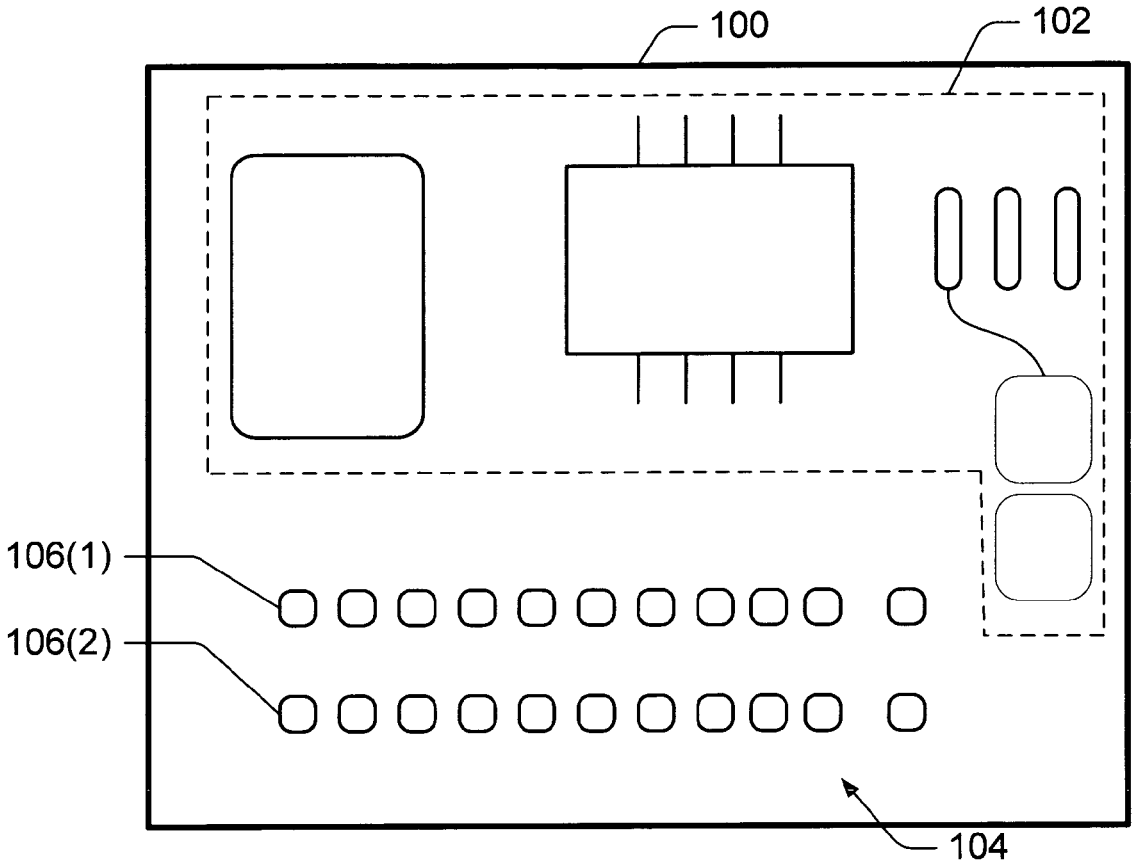
FIG. 1 illustrates a top view of a conventional circuit pack such as a motherboard for a communications device.

FIG. 1 illustrates a top view of a conventional circuit pack 100 such as a motherboard for a communications device. Circuit pack 100 is typically a printed circuit board or card on which components 102 may be mounted and interconnected to provide a functional unit of the communications device when installed therein. Circuit packet 100 includes a Small Form Factor (SFF) transceiver footprint 104 ("SFF footprint") configured to receive a conventional SFF transceiver.

Figure 2:
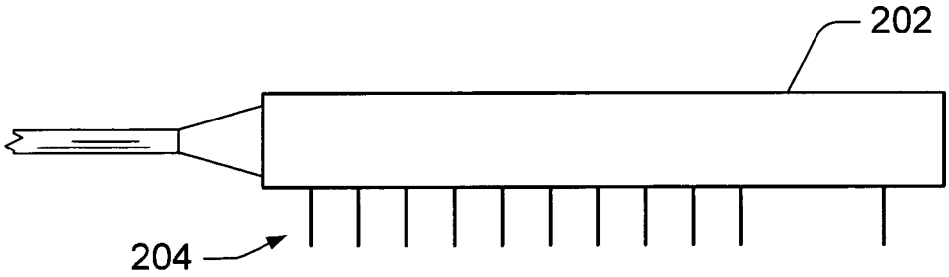
FIG. 2 shows a side-view of a conventional SFF transceiver.

FIG. 2 shows a side-view of a conventional SFF transceiver 202. With reference to FIGS. 1 and 2 two rows of holes 106(1) and 106(2) of SFF footprint 104 are spatially arranged in direct alignment with two rows of pins 204 (only one row can be seen in the side view of FIG. 2) of a SFF transceiver 202. In other words, holes 106(1) and 106(2) are complementary in terms of spatial, mechanical and electrical arrangement with the pins of a SFF transceiver 202. Spacing dimensions between each successive pin (or each hole), as well as mechanical and electrical assignments, are dictated by the SFF industry standard. Accordingly, if an SFF transceiver 202 were mounted to a circuit pack 100, pins 204 of SFF transceiver 202 would line-up to fit in holes 106(1) and 106(2) of SFF footprint 104. It is also possible that SFF transceiver 202 could be surface-mounted to circuit pack 100.

Figure 3:
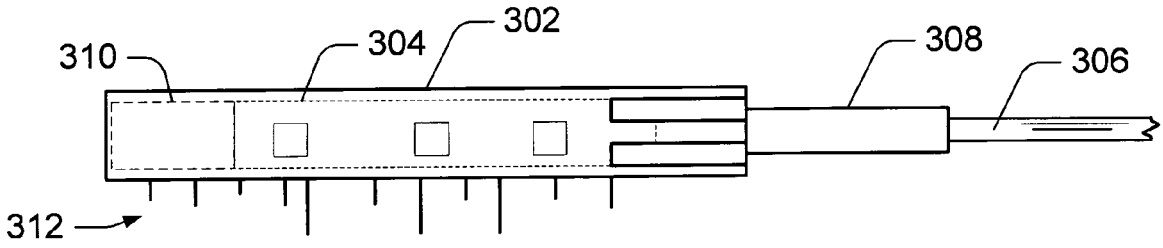
FIG. 3 is a side view of an SFP transceiver housing with SFP transceiver and fiber optic cable installed.

FIG. 3 is a side view of a Small Form Factor Pluggable transceiver housing 302 (SFP housing). SFP housing 302 is also commonly referred to in the industry as a cage in which an SFP transceiver 304 (shown as a dashed line) can be inserted and connected to a fiber cable 306 via a connector 308. SFP housing 302 surrounds a SFP connector 310 (shown as a dashed line), which is configured to attach directly to a printed circuit board. SFP housing 302 and SFP connector 310 include fastening devices 312 such as electrical leads and pins spaced apart and positioned in accordance with the SFP industry standard. These fastening devices are not electrically or mechanically compatible with the SFF industry standard. As a result, SFP housing 302 and SFP connector 310 will not lineup and connect directly with holes 106 (FIG. 1) of SFF footprint 104 (FIG. 1). In other words, the SFP housing 302 and connector 310 have fastening devices 312 which are incongruent (electrically, mechanically, and spatially) and will not align or connect with SFF footprint 104 (FIG. 1).

Figure 4:
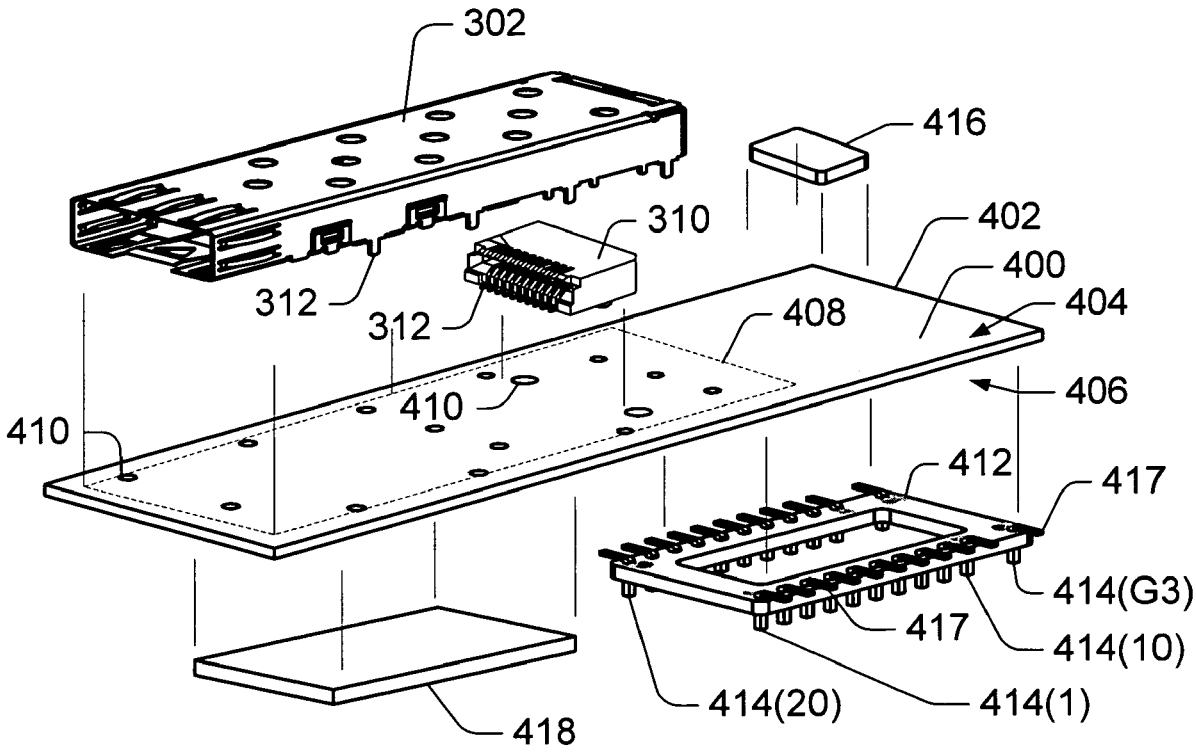
FIG. 4 illustrates an exploded isometric view of an embodiment of the innovative adapter.

To resolve this problem, the inventors developed an innovative adapter configured to interconnect an SFP transceiver 304 to an SFF footprint 104 of a circuit pack 100. FIG. 4 illustrates an exploded isometric view of an embodiment of such an adapter 400. Adapter 400 includes a printed circuit board 402, a receptacle side 404, a connector side 406, an SFP footprint 408, an SFF connector 412, and an electrical module 416.

Circuit board 402 is typically an FR4 circuit board. Circuit board 402 includes conductive traces (not shown in FIG. 4) for interconnecting electrical components that may be surface-mounted or through-hole mounted to circuit board 402 of adapter 400. The interconnected components provide a direct electrical interface between SFP connector 310 and an SFF footprint 104 (FIG. 1). Alternative suitable substrates may be used in place of FR4.

Referring now to receptacle side 404 of adapter 400 is SFP footprint 408. SFP footprint 408 contains holes 410 configured to align in a complementary manner with counterpart pins and fastening mechanisms 312 of SFP transceiver housing 302 and SFP connector 310. Accordingly, when SFP transceiver housing 302 and SFP connector 310 are attached to circuit board 402, each pin/fastening mechanism 312 contacts a corresponding hole 410 or equivalent retention mechanism of SFP footprint 408. SFP transceiver housing 302 and SFP connector 310 may be soldered to printed circuit board 402 to ensure a secure mechanical and electrical connection. Alternatively, in other implementations, clips or other fastening mechanisms may attach SFP transceiver housing 302 to printed circuit board 402.

Connector side 406 of adapter 400 includes an SFF connector 412 including a set of leads 414(1), 414(10), . . . , 414(20), and 414(G3), arranged in spatial and electrical relation to connect with SFF footprint 104 (FIG. 1) of a circuit pack 100 (FIG. 1). Accordingly, when the leads, referred to generally as reference number 414, are attached to the circuit pack 100 (FIG. 1), each lead 414 aligns with a corresponding contact or hole of footprint 104 of circuit pack 100. In one exemplary implementation, leads 414 may be pins or posts extending from connector 412 and intended to fit in holes 106 of circuit pack 100. In alternative implementations, leads 414 may be formed into gull-wing configurations for surface mounting the connector to a surface mount equivalent of footprint 104 (FIG. 1). In other alternative embodiments, it is possible for connector 412 to be attached to circuit pack 100 using other electrical and mechanical attachment mechanisms, such as employing traces of circuit pack 100 and leadless attachment techniques. For a better understanding of a technique for employing traces of a substrate as leads, see *A New Lead-frameless IC Carrier Package using Metal Base Substrate*, by Junsuke Tanaka et al., ISHM Proceedings (1995), incorporated herein by reference.

SFF connector 412 also includes gull-wing configuration leads 417 that provide an electrical and mechanical connection to circuit board 402 of adapter 400. Alternatively, SFF connector 412 could include pins in place of gull-wing leads 417 that would connect to circuit board 402. In other alternative embodiments, it is possible to attach connector 412 to circuit board 402 using other electrical and mechanical attachment mechanisms, such as employing leadless attachment techniques as mentioned above with respect to leads 414.

Connector side 406 also includes an external heat-sink 418 that may be attached to circuit board 402 using threaded posts (not shown) or other fastening mechanisms, to dissipate heat from SFP transceiver housing 302 on receptacle side 404. The heat-sink has two functions: it dissipates heat as well as provides a second attachment mechanism between the module and motherboard. This attachment increases the mechanical integrity of the assembly. It is possible that some less demanding environments will not need heat-sink 418.

Also shown in FIG. 4, is electrical module 416, configured to electrically interconnect SFP transceiver connector 310 to SFF connector 412. That is, electrical module 416 provides an electrical communication path between an SFP transceiver 304 (FIG. 3) (when disposed in the SFP transceiver housing 302), and leads 414 of SFF connector 412, when SFF connector 412 is attached to SFF footprint 104 (FIG. 1) of circuit pack 100. A portion of electrical module 416 includes electrical traces (not shown in FIG. 4) located on a layer of printed circuit board 402. Additionally, it is possible for electrical module 416 to include more than one discrete component, even though only one such component is illustrated in FIG. 4.

It is noted in other implementations, the electrical module 416 may be positioned in other locations, such as on the connector side 406 of adapter 400. Alternatively, electrical module 416 may be contained within circuit board 402 by superimposing electrical components into circuit traces of circuit board 402. Other possible arrangements for the positioning of electrical module 416 (and components therefore) may include placing it partially or wholly on receptacle and connector sides 404 and 406, and/or contained within circuit board 402. The components comprising electrical module 416 may also be partially or wholly encapsulated.

Figure 5:
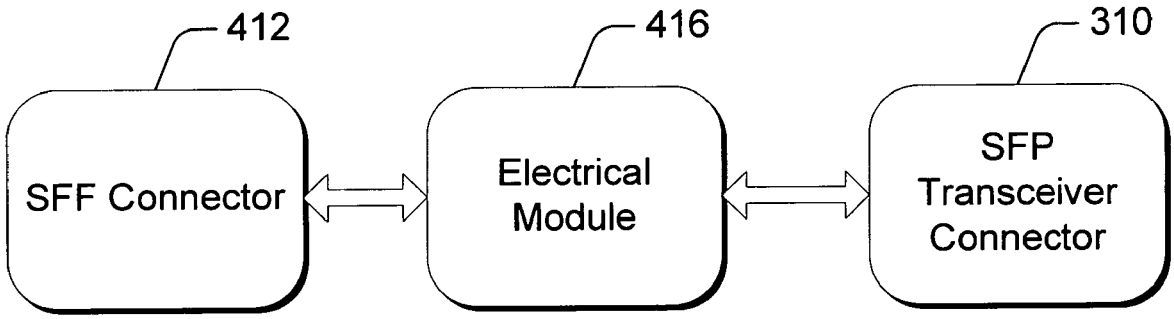
FIG. 5 is a high-level block diagram of the electrical module providing an interface between a circuit pack and an SFP transceiver when the SFP transceiver is inserted in an SFP transceiver connector.

FIG. 5 is a high-level block diagram of electrical module 416, which provides an interface between circuit module 100 and SFP transceiver 304 (FIG. 3) when inserted in SFP transceiver connector 310. In particular, electrical module 416 provides an electrical communication pathway between SFF connector 412 and SFP connector 310.

Figure 6:
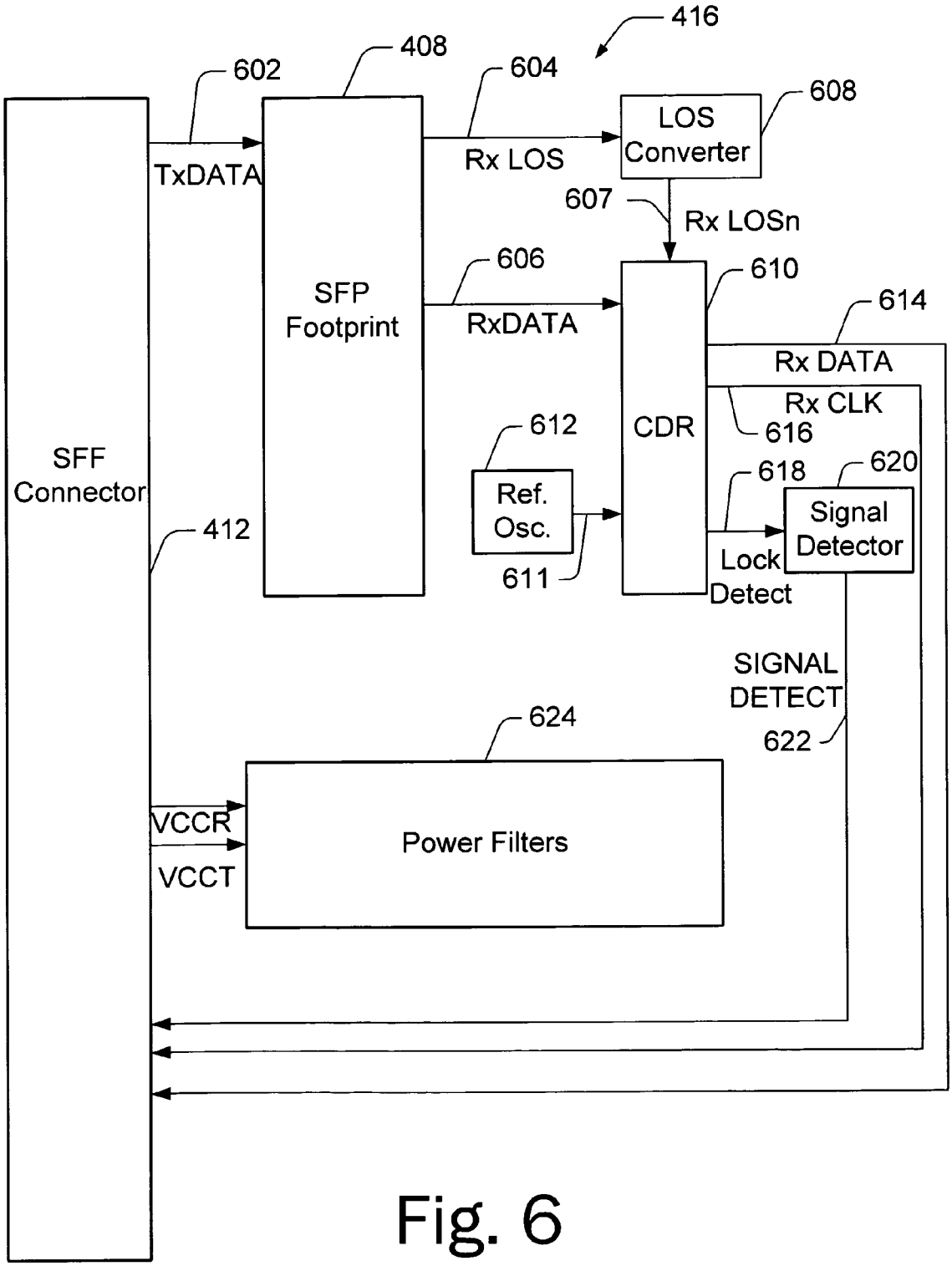
FIG. 6 is a schematic block diagram of one embodiment of an electrical module.

FIG. 6 is a schematic block diagram of one embodiment of an electrical module 416. Besides traces in circuit board 402 forming part of a communication path between an SFP transceiver and circuit pack, electrical module 416 includes: a loss of signal (LOS) converter 608, a Clock and Data Recovery module (CDR) 610, a signal detector 620, and power filters 624. Transmission and reception of data to and from transceiver 304 via electrical module 416 shall now be explained in more detail.

Data emanating from circuit pack 100 (FIG. 1) travels through SFF connector 412 to SFP footprint 408, via a transmit data signal pathway 602, which may include one or more circuit traces in circuit board 402 (FIG. 4). As used herein a pathway generally includes one or more circuit traces in circuit board 402.

Data received by SFP transceiver 304 is transmitted from SFP footprint 408 to CDR 610 via received data pathway 606. Other information transmitted from SFP footprint 408 includes a LOS indicator signal 604 to LOS converter 608. LOS indicator signal 604 indicates whether an optical signal level received by SFP transceiver 304 is at a proper level to receive data. The SFP standard dictates this signal to be a logical high when there is a loss of signal. Whereas the CDR 610 requires a logical low when there is a loss of signal. Accordingly, LOS converter 608 changes the positive logic LOS signal 604 to a negative logic signal 607.

CDR 610 coordinates the transmission of received data from SFP footprint 408 to SFF connector 412. For example, CDR 610 uses a phase locked loop (PLL) (not shown) to coordinate the transmission of received data and the recovered clock to circuit pack 100. This is accomplished by synchronizing the PLL with a reference clock signal 611 transmitted by reference oscillator 612. The CDR produces a lock detect signal, a recovered clock signal, and recovered data signal, which are transmitted via pathways 618, 616, and 614, respectively. Pathways 614 and 616 are connected to SFF connector 412 for interconnecting adapter 400 (FIG. 4) to SFF circuit footprint 104 (FIG. 1).

The lock detect signal is received by signal detector 620 which converts the signal level to a level required by circuit pack 100 configured for an SFF transceiver. The signal detect output is transmitted to SFF connector 412 via pathway 622 and ultimately to circuit pack 100 via footprint 104.

Power filters 624 isolate and filter power from the circuit pack 100 for use by SFP transceiver 304 (FIG. 3) and LOS converter 608, CDR 610, reference oscillator 612, and signal detector 620. Power filters 624 ensure there is compatible signal and power operation between an SFF centric circuit pack 100 and SFP transceiver 304.

The electrical module 416 is only one example of a suitable communications environment and is not intended to suggest any limitation as to the scope of use or functionality of circuitry that could be used herein. Additionally, the exemplary communications environment should not be interpreted as having any dependency or requirement relating to any one or combination of components illustrated in electrical module 416.

Figure 7:
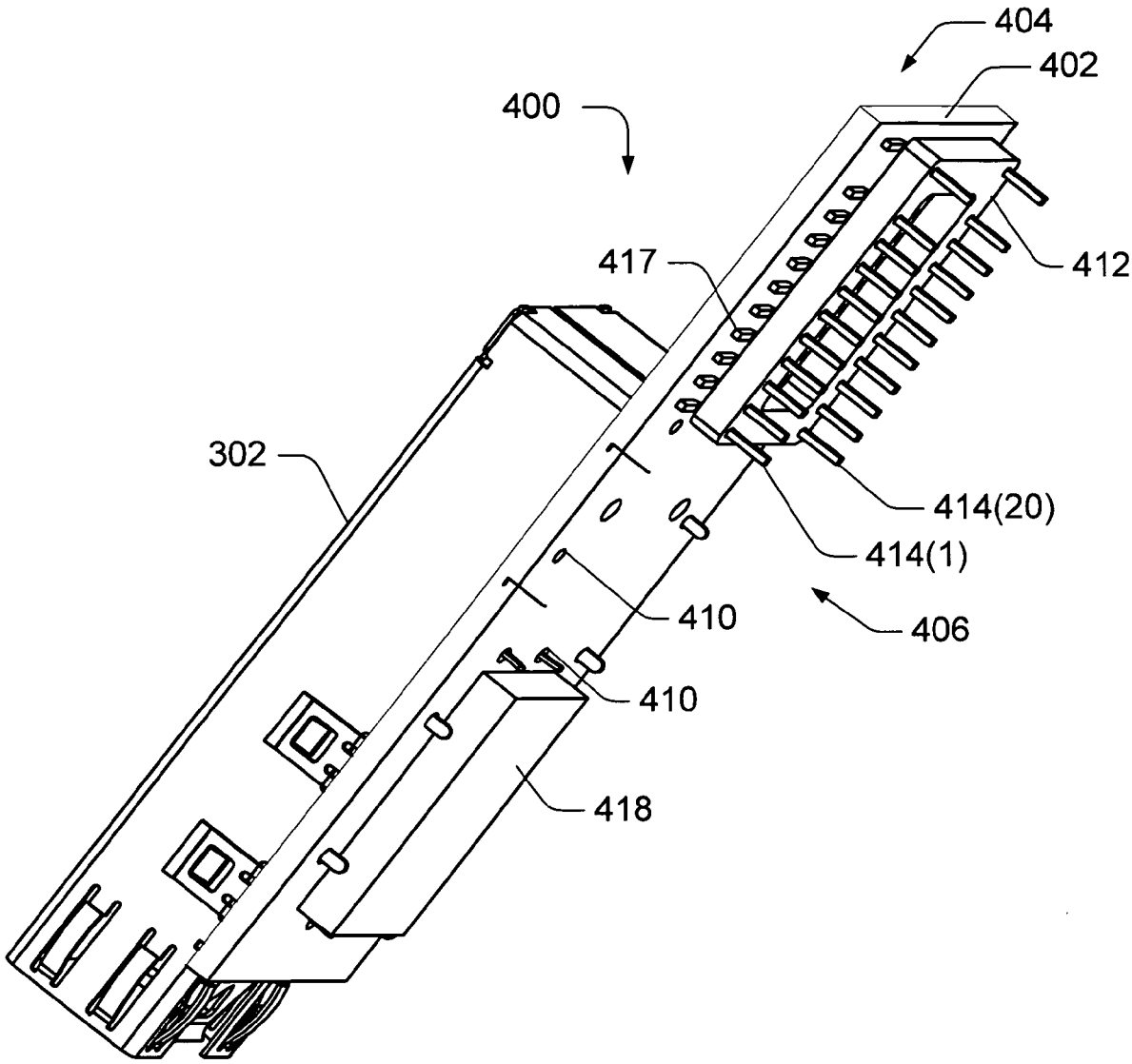
FIG. 7 is an isometric view of the innovative adapter from the perspective of the connector side of the adapter.

FIG. 7 is an isometric view of adapter 400 from the perspective of the connector side 406. In this embodiment, gull-wing leads 417 are attached directly to circuit board 402 via pads (not shown). Again, leads 414 of connector 412 follow the SFF industry standard so that they match holes 106 (FIG. 1) of SFF footprint 104 (FIG. 1).

Accordingly, an innovative exemplary embodiment of an adapter has been presented that provides a way to salvage circuit packs that use SFF transceivers without having to redesign the circuit packs, artwork on the circuit packs, or faceplates of the circuit pack. This will allow communication equipment manufacturers and communication providers to update their transceivers to the latest SFP industry standard transceivers without having to redesign circuit packs.

It is also noted that the SFP connector 310, SFP housing 302, and SFF connector 412 may be located on either side of circuit board 402. For example, in one alternative embodiment all connectors and the SFP housing 302 may be placed on the receptacle side 406 of circuit board 402.

The described embodiments are to be considered in all respects only as exemplary and not restrictive. The scope of the invention is, therefore, indicated by the appended claims rather by the foregoing description. All changes which come within the meaning and range of equivalency of the claims are to be embraced within their scope.

What is claimed is:

1. An assembly, comprising:

a printed circuit board having a first side and a second side;

a Small Form Factor Pluggable (SFP) housing and SFP connector attached to the first side of the printed circuit board;

a Small Form Factor (SFF) connector attached to the second side of the printed circuit board;

an electrical module on the printed circuit board, the electrical module configured to provide an electrical communication path between the SFP connector and the SFF connector when an SFP transceiver is plugged into the SFP transceiver housing, and the SFF connector is attached to a circuit pack of a communications device wherein the SFF connector comprises leads arranged to engage with holes of an SFF footprint located on the circuit pack of the communications device.

2. An assembly, comprising:

a printed circuit board having a first side and a second side;

a Small Form Factor Pluggable (SFP) housing and SFP connector attached to the first side of the printed circuit board;

a Small Form Factor (SFF) connector attached to the second side of the printed circuit board;

an electrical module on the printed circuit board, the electrical module configured to provide an electrical communication path between the SFP connector and the SFF connector when an SFP transceiver is plugged into the SFP transceiver housing, and the SFF connector is attached to a circuit pack of a communications device wherein the first side of the printed circuit board comprises an SFP footprint having holes configured to receive connector elements of the SFP transceiver housing when the SFP transceiver housing is attached to the first side of the circuit board.

3. The assembly as recited in claim 2, wherein the electrical module comprises circuit traces, contained in the circuit board, electrically interconnecting the SFP footprint with the leads of the connector side.

4. An adapter for interconnecting a Small Form Factor Pluggable (SFP) transceiver housing and SFP connector to a circuit pack having a Small Form Factor (SFF) footprint configured to receive leads of an SFF transceiver, the adapter comprising:

a circuit board having a receptacle side and a connector side, the receptacle side of the circuit board having an SFP footprint configured to interface the SFP transceiver housing and SFP connector when the SFP transceiver housing and SFP connector are attached to the circuit board, the connector side of the circuit board having leads arranged to engage with the SFF footprint of the circuit pack; and an electrical module configured to provide an electrical communication path between (i) the SFP footprint and (ii) the leads of the connector side of the circuit board when an SFP transceiver is inserted in the SFP transceiver housing and connected to the SFP connector, and the leads of the connector side of the circuit board are attached to the SFF footprint of the circuit pack.

5. The adapter as recited in claim 4, wherein the connector elements of the SFP transceiver housing include at least one of an electrical pin and a mechanical fastening device.

6. The adapter as recited in claim 4, wherein the SFP footprint includes apertures each spaced apart in relation to a corresponding connector element of the SFP transceiver housing such that when the SFP transceiver housing and the SFP footprint are connected to each other, the apertures of the receptacle and the connector elements of the SFP transceiver housing align with one another.

7. The adapter as recited in claim 4, wherein the leads are at least one of an electrical pin and a fastening mechanism.

8. The adapter as recited in claim 4, wherein the electrical module comprises circuit traces, contained in the circuit board, electrically interconnecting the SFP footprint with the leads of the connector side.

9. The adapter as recited in claim 4, wherein the electrical module comprises a clock and data recovery circuit configured to coordinate transmission data from SFP footprint to the leads of the connector side of the circuit board when an SFP transceiver is inserted in the SFP transceiver housing and connected to the SFP connector, and the leads of the connector side of the circuit board are attached to the SFF footprint of the circuit pack.

10. An adapter for interconnecting a Small Form Factor Pluggable (SFP) transceiver to a circuit pack configured to receive a Small Form Factor (SFF) transceiver, the adapter comprising:

a substrate comprising an SFP footprint configured to receive connector elements from an SFP transceiver housing and an SFP connector when the SFP housing and SFP connector are attached to the substrate;

leads extending from the substrate spaced apart in relation to a corresponding SFF footprint of the circuit pack so that when the leads are connected to holes of the SFF footprint, the leads and the SFF footprint engage with each other.

11. The adapter as recited in claim 10, further comprising an electrical module configured to provide an electrical communication path between (i) the SFP footprint and (ii) the leads of the connector side of the substrate when an SFP transceiver is plugged into the SFP transceiver housing and the SFP connector, and the leads extending from the substrate are attached to the SFF footprint of the circuit pack.

12. The adapter as recited in claim 10, wherein the connector elements of the SFP transceiver housing include at least one of an electrical pin and a mechanical fastening device.

13. The adapter as recited in claim 10, wherein the SFP footprint includes apertures each spaced apart in relation to a corresponding connector element of the SFP transceiver housing and SFP connector such that when the SFP transceiver housing and the SFP connector, are connected to the SFP footprint, the apertures of the SFP footprint and the connector elements align.

14. The adapter as recited in claim 10, wherein the leads are at least one of an electrical pin and a fastening mechanism.

15. The adapter as recited in claim 10, wherein the substrate is a printed circuit board.

16. The adapter as recited in claim 10, wherein the SFP connector, the SFP housing, and the leads extending from the substrate are all located on the same side of the substrate.

17. The adapter as recited in claim 10, wherein the SFP connector, the SFP housing are located on one side of the substrate, and the leads extending from the substrate are all located on an other side of the substrate.

18. The adapter as recited in claim 10, further comprising a heat sink attached to the substrate.

* * * * *